US007665643B2

(12) United States Patent
Huang

(10) Patent No.: US 7,665,643 B2
(45) Date of Patent: Feb. 23, 2010

(54) STAPLER WITH ENERGY-SAVE MECHANISM

(76) Inventor: Chien Chuan Huang, No. 37, Teuen Lan Lane, Yuan Tung Road, Yuan Lin Town, Chang Hua Hsien (TW)

( * ) Notice: Subject to any disclaimer, the term of this patent is extended or adjusted under 35 U.S.C. 154(b) by 120 days.

(21) Appl. No.: 12/153,637

(22) Filed: May 22, 2008

(65) Prior Publication Data

US 2009/0289095 A1 Nov. 26, 2009

(51) Int. Cl.
*B25C 5/00* (2006.01)
*B27F 7/00* (2006.01)

(52) U.S. Cl. ..... 227/128; 227/134

(58) Field of Classification Search ..... 227/77, 227/120, 127, 128, 134, 154, 155
See application file for complete search history.

(56) References Cited

U.S. PATENT DOCUMENTS 3,739,973 A * 6/1973 Abrams ..... 227/120
5,421,502 A * 6/1995 Huang ..... 227/134
6,626,346 B2 * 9/2003 Jairam et al. ..... 227/127
6,789,719 B2 * 9/2004 Shor ..... 227/132
7,097,088 B2 * 8/2006 Shor ..... 227/132
7,216,791 B1 * 5/2007 Marks ..... 227/132
7,322,504 B2 * 1/2008 Chen ..... 227/129
7,431,186 B2 * 10/2008 Hsu ..... 227/120
7,540,400 B2 * 6/2009 Zins et al. ..... 227/8
2007/0221699 A1 * 9/2007 Hsu ..... 227/134

* cited by examiner

*Primary Examiner*—Paul R Durand
(74) *Attorney, Agent, or Firm*—Bacon & Thomas, PLLC

(57) ABSTRACT

A stapler includes a base having two frames on first end thereof and a magazine and an arm are respectively pivotably connected to the frames. A first link has a first end movably and pivotably connected with a slot defined in the arm and a second end of the first link is movably and pivotably connected to a first end of a second link. A hole is defined through the first link and located between the first and second ends of the first link. A pin extends the through hole and removably rested on the top of the frames. The second link is pivotably the frames at its mediate portion. The arm pivots the first link which pivots the second link so that the second end of the second link generates a significant force to the staples.

8 Claims, 7 Drawing Sheets

STAPLER WITH ENERGY-SAVE MECHANISM

FIELD OF THE INVENTION

The present invention relates to a stapler with an energy-save mechanism which generates a huge force to the staples with less force applied to the arm of the stapler.

BACKGROUND OF THE INVENTION

A conventional stapler 7 is shown in FIG. 5 and generally includes a base 71 with a magazine 72 pivotably connected to a frame extending from a first end of the base 71, and an anvil 77 is located on a top of a second end of the base 71. An arm 73 has a first end pivotably connected to the frame by a pin 74 and a push plate 75 extends from an underside of a second end of the arm 73. The push plate 75 is inserted into the magazine 72 and pushes one staple in the magazine 72 to staple a pile of document located between the base 71 and the magazine 72. Two legs of each staple are then bent inward when contacting the anvil 77.

The user applies a force at the second end of the arm 73 to push the staples to penetrate the document to staple the document. It is noted that the resistance is significant when the document is thick so that the user has to apply a force that is larger than the resistance such that the staples can penetrate the document. The users have a common experience that the hand operating the arm 73 feel painful after many times of stapling actions or if the resistance from the document is huge.

The present invention intends to provide a stapler that can use less force to generate sufficient force to staple document.

SUMMARY OF THE INVENTION

The present invention relates to a stapler and the stapler comprises a base having two frames extending from a top of a first end thereof and an anvil is located on the top of a second end of the base. A magazine has a first end pivotably connected between first ends of the two frames and an outlet is defined through an underside of the magazine. An arm has a slot defined therethrough and a first end of the arm is pivotably connected to the first ends of the two frames. A link unit is located between the arm and the magazine, the link unit includes a first link and a second link. The first link has a first end movably and pivotably connected with the slot. A second end of the first link is movably and pivotably connected to pivotal holes defined in a first end of the second link. A hole is defined through the first link and located between the first and second ends of the first link. A pin extends the through hole and is removably rested on the top of the frames. A fulcrum hole is defined in a mediate portion of the second link and a pin extends through holes defined through two respective second ends of the frames and the fulcrum hole. The holes in the second ends of the frames are located close to the second end of the base. A push plate is connected to the second end of the second link and located corresponding to the outlet of the magazine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
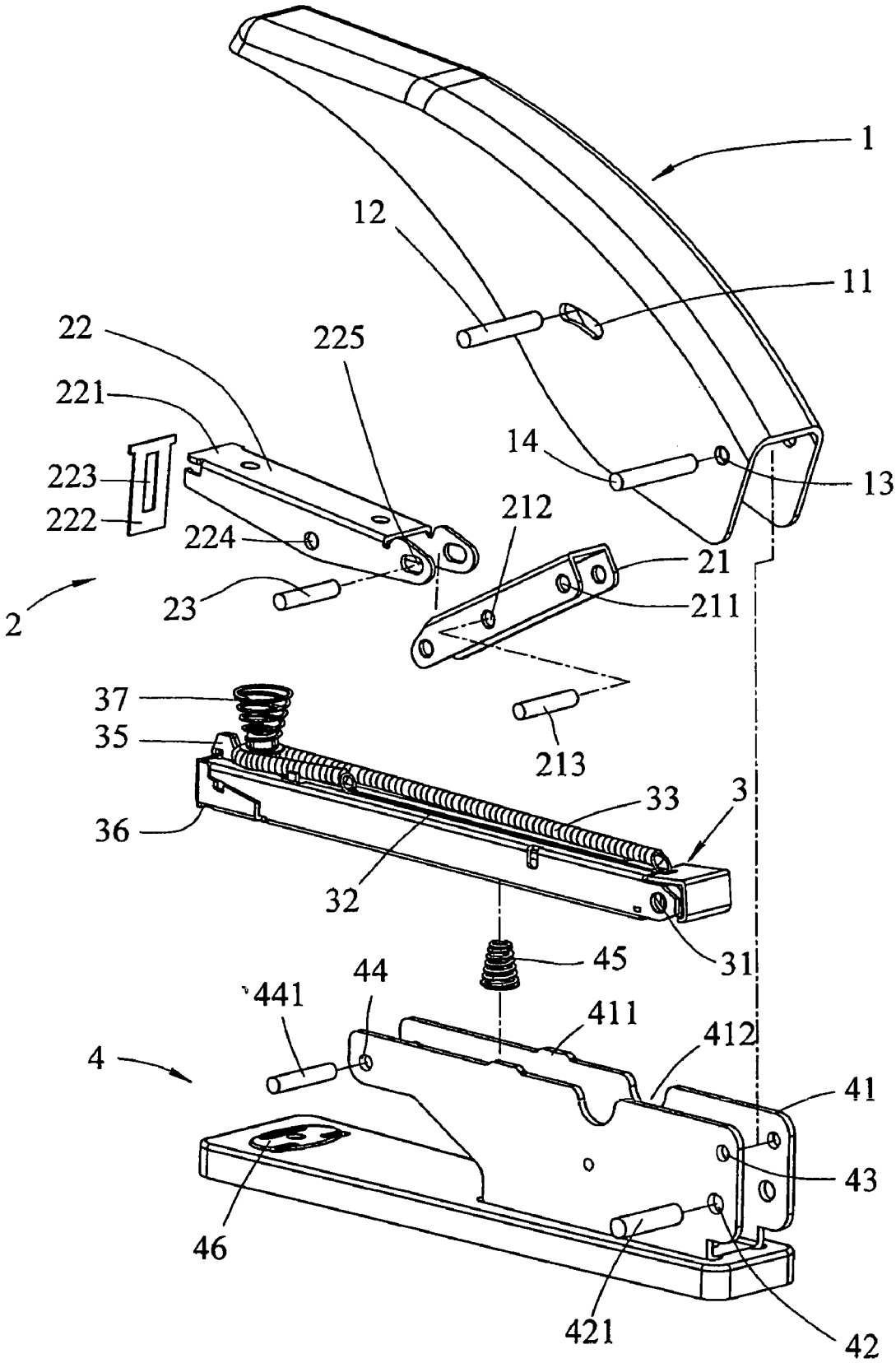
FIG. 1 is an exploded view to show the stapler of the present invention.
Figure 2:
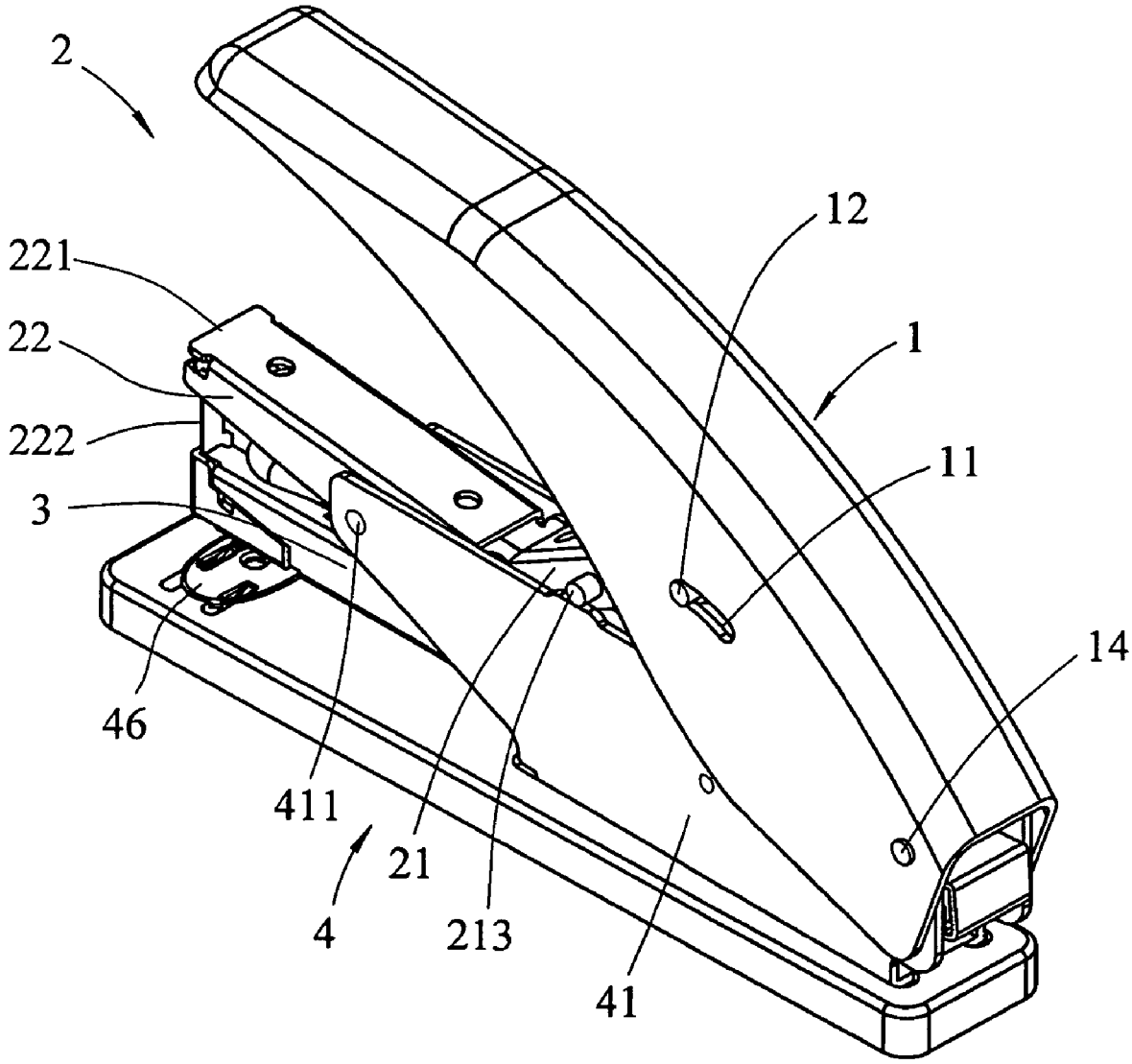
FIG. 2 is a perspective view to show the stapler of the present invention.
Figure 3:
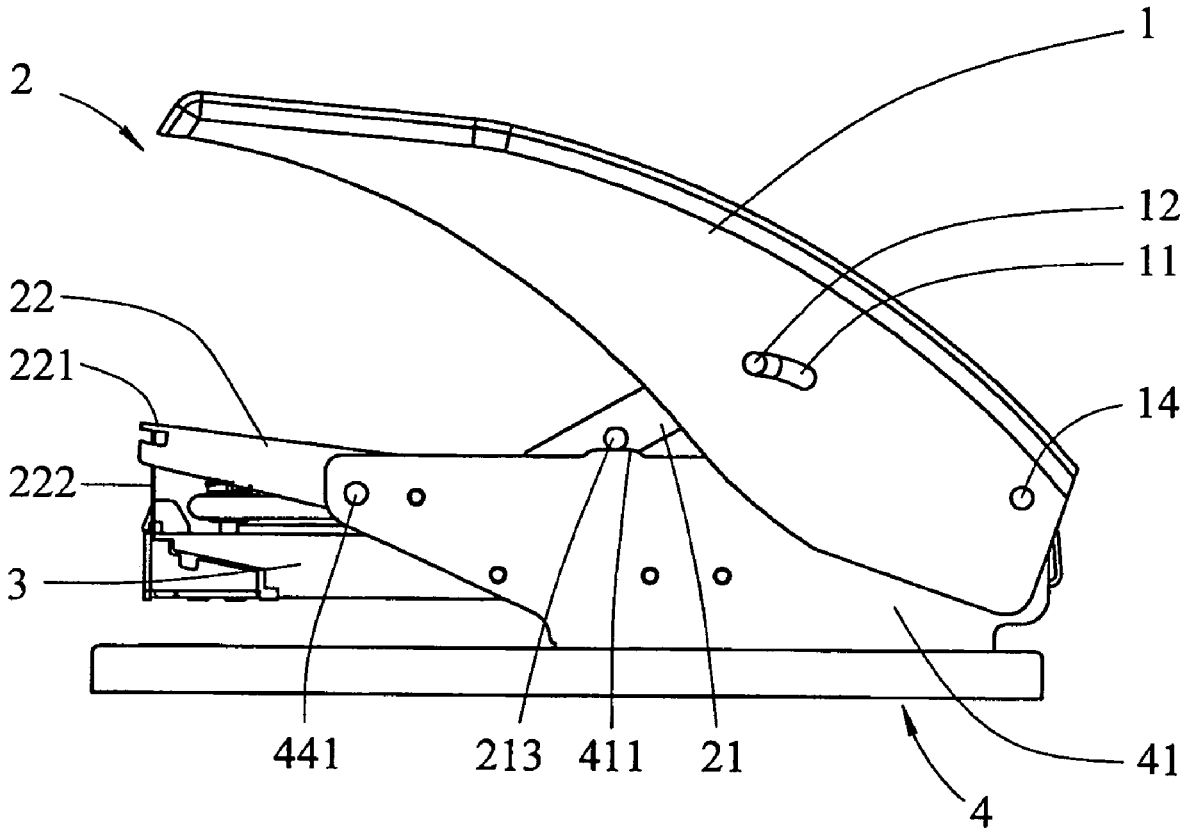
FIG. 3 is a side view to show the stapler of the present invention.

Referring to FIGS. 1 to 4A, the stapler of the present invention comprises a base 4 having two frames 41 extending from a top of a first end thereof and an anvil 46 is located on the top of a second end of the base 4. The two frames 41 have two holes 42, 43 defined in the first ends thereof, the holes 43 are located higher than that of the holes 42. Two holes 44 are defined through two respective second ends of the frames 41 and located close to the second end of the base 4. The two frames 41 each have a notch 412 defined in a top thereof and two protrusions 411 extending from the top thereof.

A magazine 3 has a first end pivotably connected between the first ends of the two frames 41 by extending a pin 421 through the holes 42 and a hole 31 in the magazine 3. The magazine 3 further has a rail 32 formed therein and a spring 33 has one end fixed to the first end of the magazine 3 and the other end of the spring 33 is connected with a pusher 34 which is movably engaged with the rail 32. An outlet 36 is defined through an underside of the second end of the magazine 3. Staples 5 are received in the magazine 3 and pushed by the pusher 34. A spring 45 is located between the magazine 3 and the base 4.

An arm 1 has a slot 11 defined therethrough and a first end of the arm 1 has a hole 13 and a pin 14 extends through the hole 13 and the holes 43 so as to pivotably connect the arm 1 to the first ends of the two frames 41.

A link unit 2 is located between the arm 1 and the magazine 3, the link unit 2 includes a first link 21 and a second link 22. The first link 21 has a first end movably and pivotably connected with the slot 11 by a pin 12 extending through the hole 211 in the first end of the first link 21 and the slot 11. A second end of the first link 21 is movably and pivotably connected to pivotal holes 225 defined in a first end of the second link 22 by a pin 23. A hole 212 is defined through the first link 21 and located between the first and second ends of the first link 21. A pin 213 extends the through hole 212 and removably rested on the protrusions 411 on the top of the frames 41. As shown in FIG. 4C, a distance "Y" between the first end of the first link 21 and the hole 212 is longer than a distance "Z" between the second end of the first link 21 and the hole 212. A fulcrum hole 224 is defined in a mediate portion of the second link 22 and a pin 441 extends through holes 44 defined through two respective second ends of the frames 41 and the fulcrum hole 224. The holes 44 are located close to the second end of the base 4. A push plate 222 is connected to the second end of the second link 22 and located corresponding to the outlet 36 of the magazine 3. A tongue 221 extends from the second end of the second link 22 and the push plate 222 has a passage 223 in which the tongue 221 is engaged. A hook 35 extends from the second end of the magazine 3 and hooks the passage 223. A spring 37 is located between the second end of the second link 22 and the magazine 3.

Figure 4A:
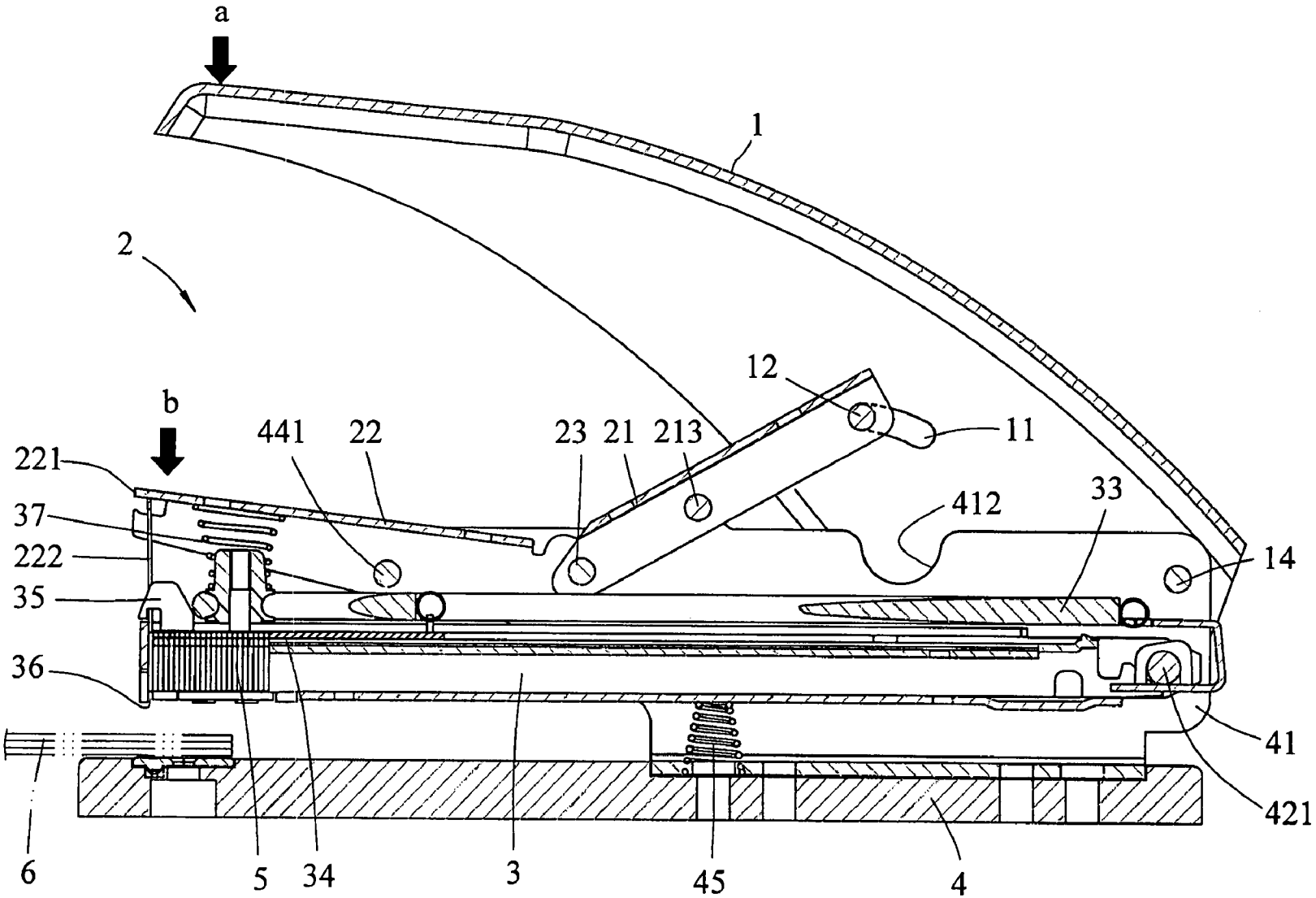
FIG. 4A is a partial cross sectional view to show the stapler of the present invention.
Figure 4B:
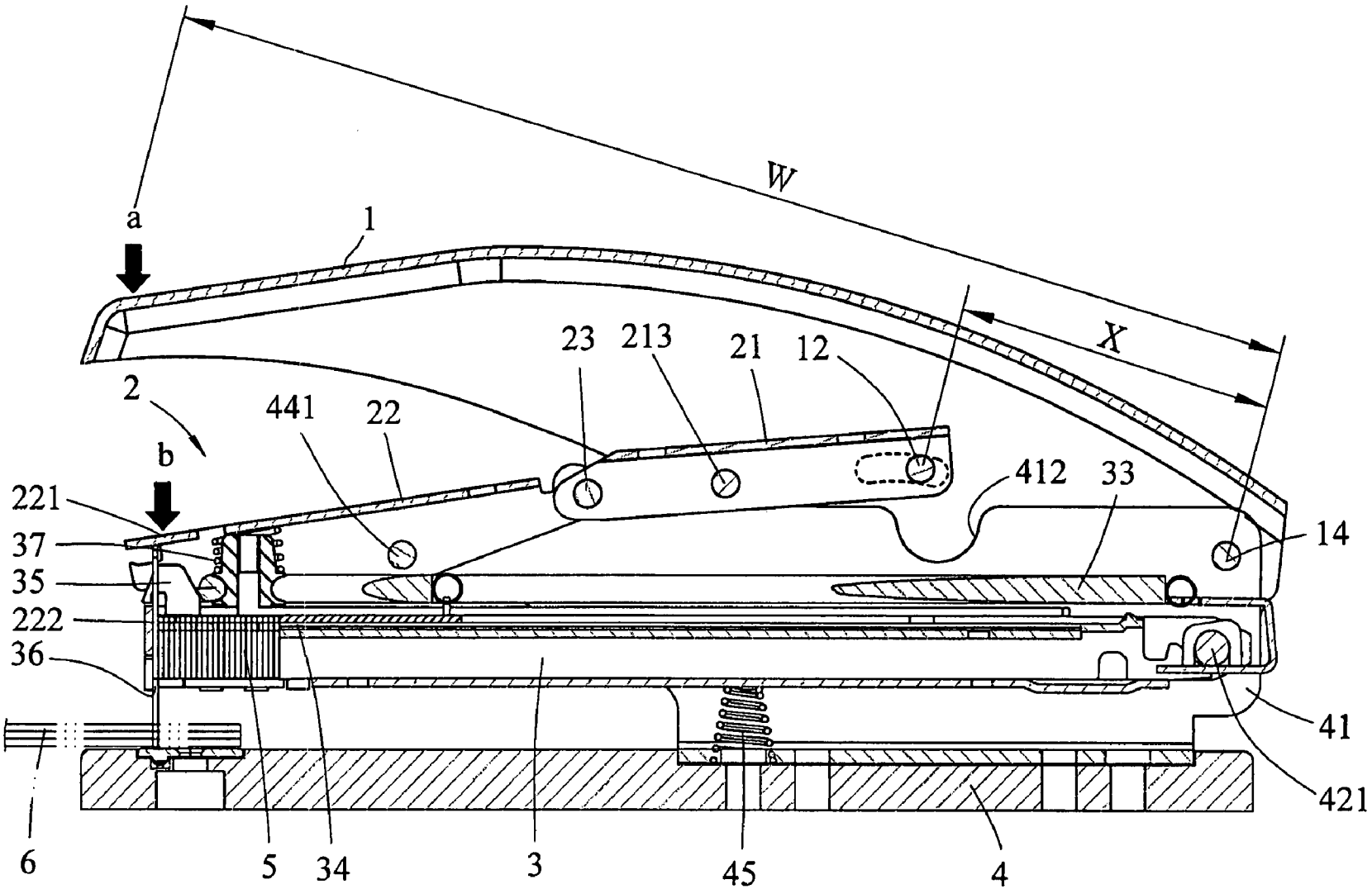
FIG. 4B is a partial cross sectional view to show that the arm is pivoted downward.
Figure 4C:
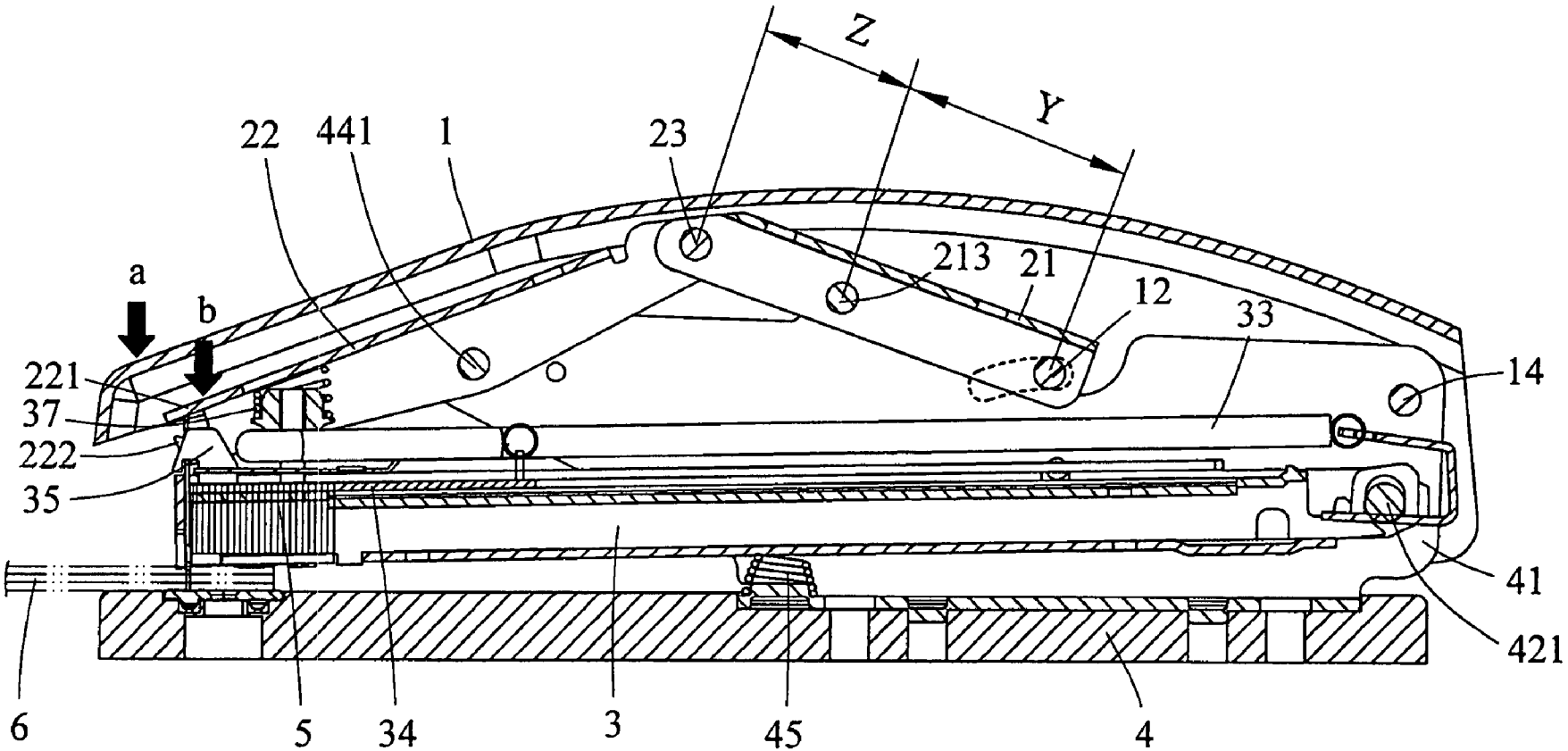
FIG. 4C is a partial cross sectional view to show that the arm is pivoted to its lowest position.
Figure 5:
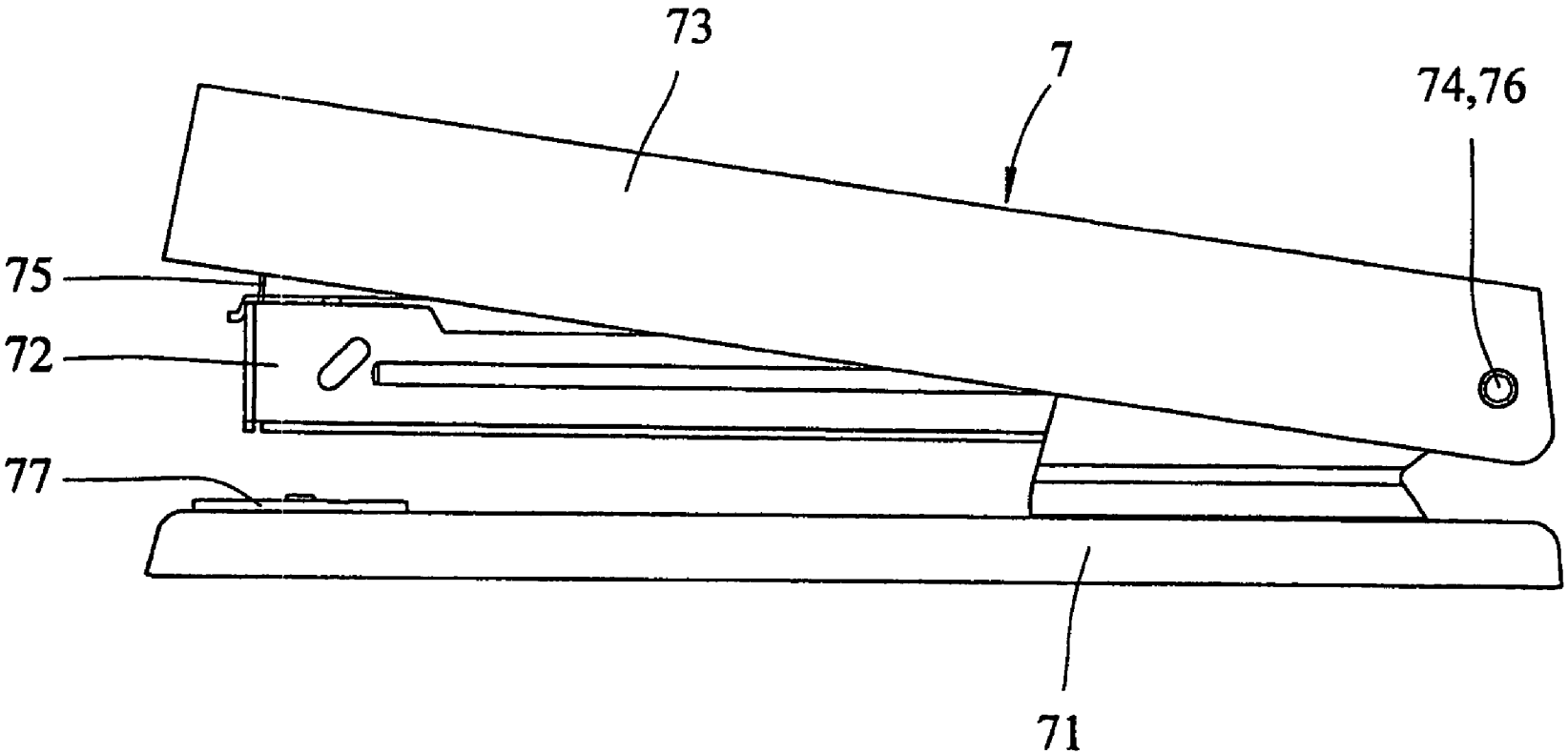
FIG. 5 PRIOR ART
FIG. 5 shows a conventional stapler.

As shown in FIGS. 4A, 4*b* and 4C, when applying a force "a" at the second end of the arm 1, because the distance "W" from the pin 14 to the point of the force "a" is longer than the distance "X" from the pin 14 to the pin 12, so that the first end of the first link 21 is moved within the slot 11 and the second end of the first link 21 lifts the first end of the second link 22. Because the distance "Y" between the first end of the first link 21 and the hole 212 is longer than a distance "Z" between the second end of the first link 21 and the hole 212, it is easy to pivot the first link 21 with the fulcrum at the pin 213. When the pivoting action of the arm 1 continues and moves to its lowest position, as shown in FIG. 4C, the pin 12 is engaged with the notches 412 and the second end of the second link 22 is lowered to allow the push plate 222 to push one staple 5 out from the outlet 36 and the staple 5 penetrates through the document 6 located between the magazine 3 and the base 4. The force "b" applied to the push plate 222 is sufficient and significant with less force "a" applied to the arm 1.

While we have shown and described the embodiment in accordance with the present invention, it should be clear to those skilled in the art that further embodiments may be made without departing from the scope of the present invention.

What is claimed is:

1. A stapler comprising:

a base (4) having two frames (41) extending from a top of a first end thereof and an anvil (46) located on the top of a second end of the base (4);

a magazine (3) having a first end pivotably connected between first ends of the two frames (41) and an outlet (36) defined through an underside of the magazine (3);

an arm (1) having a slot (11) defined therethrough and a first end of the arm (1) pivotably connected to the first ends of the two frames (41), and a link unit (2) located between the arm (1) and the magazine (3), the link unit (2) including a first link (21) and a second link (22), the first link (21) having a first end movably and pivotably connected with the slot (11) by a pin (12), a second end of the first link (21) movably and pivotably connected to pivotal holes (225) defined in a first end of the second link (22) by a pin (23), a hole (212) defined through the first link (21) and located between the first and second ends of the first link (21), a pin (213) extending the through hole (212) and removably rested on the top of the frames (41), a distance between the first end of the first link (21) and the hole (212) being longer than a distance between the second end of the first link (21) and the hole (212), a fulcrum hole (224) defined in a mediate portion of the second link (22) and a pin (441) extending through holes (44) defined through two respective second ends of the frames (41) and the fulcrum hole (224), the holes (44) located close to the second end of the base (4), a push plate (222) connected to the second end of the second link (22) and located corresponding to the outlet (36) of the magazine (3).

2. The stapler as claimed in claim 1, wherein the two frames (41) each have a notch (412) defined in a top thereof and the pin (12) is engaged with the notches (412) when the arm (1) is pivoted downward.

3. The stapler as claimed in claim 1, wherein the two frames (41) each have a protrusion (411) extending from a top thereof and the pin (213) is removably rested on the protrusions (411).

4. The stapler as claimed in claim 1, wherein a tongue (221) extends from the second end of the second link (22) and the push plate (222) has a passage (223) in which the tongue (221) is engaged, a hook (35) extends from the second end of the magazine (3) and hooks the passage (223).

5. The stapler as claimed in claim 1, wherein a spring (37) is located between the second end of the second link (22) and the magazine (3).

6. The stapler as claimed in claim 1, wherein a spring (45) is located between the magazine (3) and the base (4).

7. The stapler as claimed in claim 1, wherein the magazine (3) has a rail (32) formed therein and a spring (33) has one end fixed to the first end of the magazine (3) and the other end of the spring (33) is connected with a pusher (34) which is movably engaged with the rail (32).

8. The stapler as claimed in claim 1, wherein the two frames (41) have two holes (42, 43) defined in the first ends thereof, the holes (43) are located higher than that of the holes (42), the first end of the arm (1) is pivotably connected to the holes (43) and the first end of the magazine (3) is pivotably connected to the holes (42).

* * * * *